US011668292B2

(12) United States Patent
Teshima et al.

(10) Patent No.: US 11,668,292 B2
(45) Date of Patent: Jun. 6, 2023

(54) ROLLING DIAPHRAGM PUMP

(71) Applicant: NIPPON PILLAR PACKING CO., LTD., Osaka (JP)

(72) Inventors: Kazukiyo Teshima, Osaka (JP); Yu Notoji, Osaka (JP); Shingo Higuchi, Osaka (JP)

(73) Assignee: NIPPON PILLAR PACKING CO., LTD., Osaka (JP)

( * ) Notice: Subject to any disclaimer, the term of this patent is extended or adjusted under 35 U.S.C. 154(b) by 51 days.

(21) Appl. No.: 17/605,265

(22) PCT Filed: Feb. 7, 2020

(86) PCT No.: PCT/JP2020/004978
§ 371 (c)(1),
(2) Date: Oct. 21, 2021

(87) PCT Pub. No.: WO2020/217647
PCT Pub. Date: Oct. 29, 2020

(65) Prior Publication Data

US 2022/0213882 A1 Jul. 7, 2022

(30) Foreign Application Priority Data

Apr. 23, 2019 (JP) ..... JP2019-081454

(51) Int. Cl.
*F04B 43/02* (2006.01)
*F04B 53/14* (2006.01)
*F04B 43/00* (2006.01)

(52) U.S. Cl.
CPC ..... *F04B 43/02* (2013.01); *F04B 43/0054* (2013.01); *F04B 53/14* (2013.01); *F05B 2210/11* (2013.01)

(58) Field of Classification Search
CPC ..... F04B 43/02; F04B 53/14; F04B 43/009; F04B 43/0054; F05B 2210/11
See application file for complete search history.

(56) References Cited

U.S. PATENT DOCUMENTS 3,373,694 A * 3/1968 Taplin ..... F16J 3/06 417/571
4,569,378 A * 2/1986 Bergandy ..... B65B 3/32 141/89

(Continued)

FOREIGN PATENT DOCUMENTS

JP 59-20059 U 2/1984
JP 8-198095 A 8/1996

(Continued)

OTHER PUBLICATIONS

International Search Report dated Mar. 10, 2020 issued in corresponding PCT/JP2020/004978 application (2 pages).

*Primary Examiner* — Dominick L Plakkoottam
(74) *Attorney, Agent, or Firm* — Millen, White, Zelano & Branigan, P.C.; William Nixon

(57) ABSTRACT

A rolling diaphragm 5 of a rolling diaphragm pump 1 has a movable portion 31 reciprocatable together with a piston 3, a fixed portion 32 fixed to a housing 2, and a thin film portion 33 connecting the movable portion 31 and the fixed portion 32 and bending due to reciprocation of the piston 3. A rubber layer 6 is overlaid on the thin film portion 33 without being adhered to the thin film portion 33, an end portion **6*a* on the movable portion 31 side of the rubber layer 6 is fixed to the piston 3, and an end portion 6*b* on the fixed portion 32 side of the rubber layer 6 is fixed to the housing 2**.

4 Claims, 3 Drawing Sheets

(56) References Cited

U.S. PATENT DOCUMENTS

| | | | | | |
|---|---|---|---|---|---|
| 4,749,342 | A * | 6/1988 | Fritsch | F04B 43/067 | 417/388 |
| 5,184,943 | A * | 2/1993 | Walton | F04B 13/02 | 417/511 |
| 6,247,472 | B1 * | 6/2001 | Moseley | A61G 10/026 | 128/205.24 |
| 9,784,375 | B2 * | 10/2017 | Hagmann | F16K 15/02 | |
| 10,830,226 | B2 * | 11/2020 | Teshima | F04B 39/044 | |
| 2007/0240564 | A1 * | 10/2007 | Uehara | F04B 43/02 | 92/99 |
| 2008/0226468 | A1 * | 9/2008 | Jackson | F04B 43/021 | 417/395 |
| 2010/0225478 | A1 * | 9/2010 | McCloskey | G01N 3/32 | 73/37 |
| 2012/0073432 | A1 * | 3/2012 | Ingersoll | F16K 15/20 | 92/99 |
| 2015/0300491 | A1 * | 10/2015 | Teshima | F04B 43/0063 | 92/48 |
| 2019/0186775 | A1 * | 6/2019 | Wang | G05D 7/0106 | |

FOREIGN PATENT DOCUMENTS

| | | | | |
|---|---|---|---|---|
| JP | 2010025286 | A | * | 2/2010 |
| JP | 2015-98855 | A | | 5/2015 |
| JP | 2018-25251 | A | | 2/2018 |
| JP | 2018025251 | A | * | 2/2018 |

* cited by examiner

ROLLING DIAPHRAGM PUMP

TECHNICAL FIELD

The present invention relates to a rolling diaphragm pump.

BACKGROUND ART

For example, in a production process for a semiconductor, a liquid crystal device, an organic EL device, a solar cell, etc., a rolling diaphragm pump having excellent chemical resistance is used as a pump for feeding a chemical solution when the chemical solution is applied or dispensed. In the rolling diaphragm pump, when a piston is reciprocated in a cylinder, a rolling diaphragm made of a synthetic resin makes a bending motion to change the volume of the interior of a pump chamber (pressure chamber), whereby the chemical solution is sucked into the pump chamber and discharged from the pump chamber.

Since the rolling diaphragm made of a synthetic resin has poor followability to the reciprocation of the piston, wrinkles may occur at a portion other than the bent portion during the bending motion, and the rolling diaphragm may be torn.

Therefore, in PATENT LITERATURE 1, the occurrence of the wrinkles is suppressed by reliably bringing a rolling diaphragm into close contact with a piston and a housing by using a decompression device. In addition, in PATENT LITERATURE 2, the occurrence of the wrinkles is suppressed by adhering (coating) a rubber layer to the surface of a rolling diaphragm made of a synthetic resin.

CITATION LIST

Patent Literature

PATENT LITERATURE 1: Japanese Laid-Open Patent Publication No. 2015-98855

PATENT LITERATURE 2: Japanese Laid-Open Patent Publication No. 2018-25251

SUMMARY OF INVENTION

Technical Problem

In PATENT LITERATURE 1, the decompression device for bringing the rolling diaphragm into close contact with the piston or the like is required, which increases the cost. In addition, in PATENT LITERATURE 2, in order to facilitate the adhesion of the rubber layer to the rolling diaphragm, it is necessary to perform a surface modification treatment on the rolling diaphragm, which also increases the cost.

The present invention has been made in view of such circumstances, and an object of the present invention is to provide a rolling diaphragm pump that can suppress the occurrence of wrinkles in a rolling diaphragm with an inexpensive configuration.

Solution to Problem (1) The present inventors have conducted thorough research on the mechanism by which a rubber layer can suppress the occurrence of wrinkles in a rolling diaphragm. As a result, the present inventors have found that, at a bent portion of the rolling diaphragm, an external force that bends the bent portion becomes larger than an external force that causes wrinkles in a non-bent portion, due to the strong restoring force of the rubber layer to which tension is applied, so that the occurrence of wrinkles in the non-bent portion is suppressed. Then, the present inventors have found that the force relationship between the external force that bends the bent portion and the external force that causes wrinkles does not change even if the rubber layer is not adhered to the rolling diaphragm, and have completed the present invention based on this finding.

Specifically, the rolling diaphragm pump of the present invention is a diaphragm pump including: a housing; a rolling diaphragm defining a pump chamber in the housing and made of a synthetic resin; and a piston disposed in the housing so as to be reciprocatable together with the rolling diaphragm, wherein a transport fluid is sucked and discharged by changing a volume of an interior of the pump chamber by a bending motion of the rolling diaphragm due to reciprocation of the piston, the rolling diaphragm has a movable portion reciprocatable together with the piston, a fixed portion fixed to the housing, and a thin film portion connecting the movable portion and the fixed portion and bending due to the reciprocation of the piston, a rubber layer is overlaid on the thin film portion without being adhered to the thin film portion, an end portion on the movable portion side of the rubber layer is fixed to the piston, and an end portion on the fixed portion side of the rubber layer is fixed to the housing.

According to the present invention, since the rubber layer is overlaid on the thin film portion which bends in the rolling diaphragm, the occurrence of wrinkles in the rolling diaphragm can be suppressed. In addition, since the rubber layer is overlaid on the thin film portion without being adhered to the thin film portion, the occurrence of wrinkles can be suppressed with an inexpensive configuration as compared with the conventional case where a rubber layer is adhered to a rolling diaphragm.

(2) A through hole for discharging air between the thin film portion and the rubber layer to the outside is preferably formed in the thin film portion.

In this case, since air between the thin film portion and the rubber layer can be discharged to the outside through the through hole formed in the thin film portion, plastic deformation of the thin film portion due to the air being trapped between the thin film portion and the rubber layer can be suppressed.

(3) The through hole is preferably formed in the thin film portion near the fixed portion.

Air between the thin film portion and the rubber layer is accumulated near the fixed portion during bending motion of the thin film portion. Thus, since the through hole is formed in the thin film portion near the fixed portion, the air accumulated near the fixed portion can be efficiently discharged to the outside.

(4) A plurality of the through holes are preferably formed in the thin film portion.

In this case, air between the thin film portion and the rubber layer can be more efficiently discharged to the outside through the plurality of the through holes formed in the thin film portion.

Advantageous Effects of Invention

According to the present invention, the occurrence of wrinkles in the rolling diaphragm can be suppressed with an inexpensive configuration.

DESCRIPTION OF EMBODIMENTS

Next, preferred embodiments of the present invention will be described with reference to the accompanying drawings.

Figure 1:
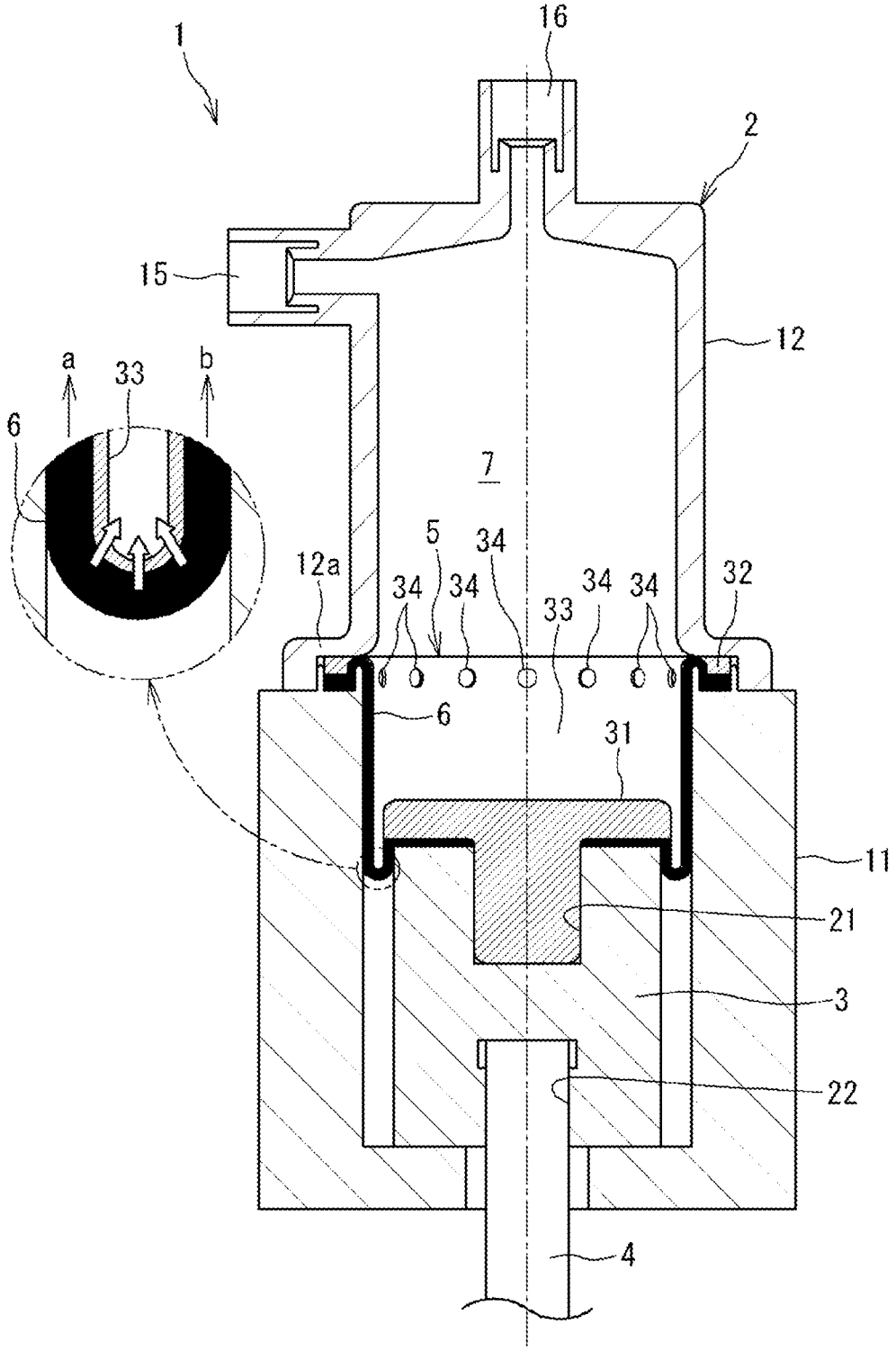
FIG. 1 is a cross-sectional view showing a state where a piston is at a lowest position in a rolling diaphragm pump according to an embodiment of the present invention.

FIG. 1 is a cross-sectional view of a rolling diaphragm pump according to an embodiment of the present invention. The rolling diaphragm pump 1 includes a housing 2, a piston 3, a shaft 4, and a rolling diaphragm 5. In the present embodiment, the rolling diaphragm pump 1 (hereinafter, also referred to simply as pump 1) is placed such that the longitudinal direction (axial direction) thereof is the up-down direction, but may be placed such that the longitudinal direction (axial direction) thereof is a horizontal direction.

[Configuration of Housing]

The housing 2 has a cylinder 11 and a pump head 12. The cylinder 11 is formed in a cylindrical shape, and is disposed such that the axial direction thereof coincides with the up-down direction. The pump head 12 is formed in a cylindrical shape with a lid, and is mounted on the upper side in the axial direction of the cylinder 11 so as to close the opening thereof. The pump head 12 has an inner diameter substantially equal to that of the cylinder 11, and, together with the cylinder 11, forms a housing space in which the piston 3 can be housed.

A suction port 15 penetrating in a direction orthogonal to the axial direction is formed in a peripheral wall portion of the pump head 12. The suction port 15 is connected to a liquid tank (not shown) for storing a liquid (transport fluid) such as a chemical solution. A discharge port 16 penetrating in the axial direction is formed in a lid portion of the pump head 12 so as to be located at a center portion of the lid portion. The discharge port 16 is connected to, for example, a liquid supply portion (not shown) such as a spray nozzle for applying the liquid.

[Configuration of Piston]

The piston 3 is disposed in the housing 2 so as to be coaxial with the housing 2 and is also disposed so as to be reciprocatable in the axial direction of the housing 2 (the up-down direction). In the present embodiment, the piston 3 is formed in a columnar shape, and has an outer diameter smaller than the inner diameter of the housing 2 (the cylinder 11 and the pump head 12). Accordingly, the outer peripheral surface of the piston 3 is located so as to be opposed to the inner peripheral surface of the housing 2 with a predetermined gap therebetween.

The piston 3 has a first recess 21 which is open upward in the axial direction, and a second recess 22 which is open downward in the axial direction. The first recess 21 and the second recess 22 are each formed at a center portion of the piston 3 and are arranged coaxially with each other. An upper end portion of the shaft 4 is fitted and fixed to the second recess 22. A drive device (not shown) for reciprocating the piston 3 between a lowest position (see FIG. 1) and an uppermost position (see FIG. 3) in the axial direction is connected to a lower end portion of the shaft 4. The drive device includes a stepping motor and a linear motion mechanism portion which converts a rotary motion of the stepping motor into a linear motion and outputs the linear motion.

[Configuration of Rolling Diaphragm]

Figure 2:
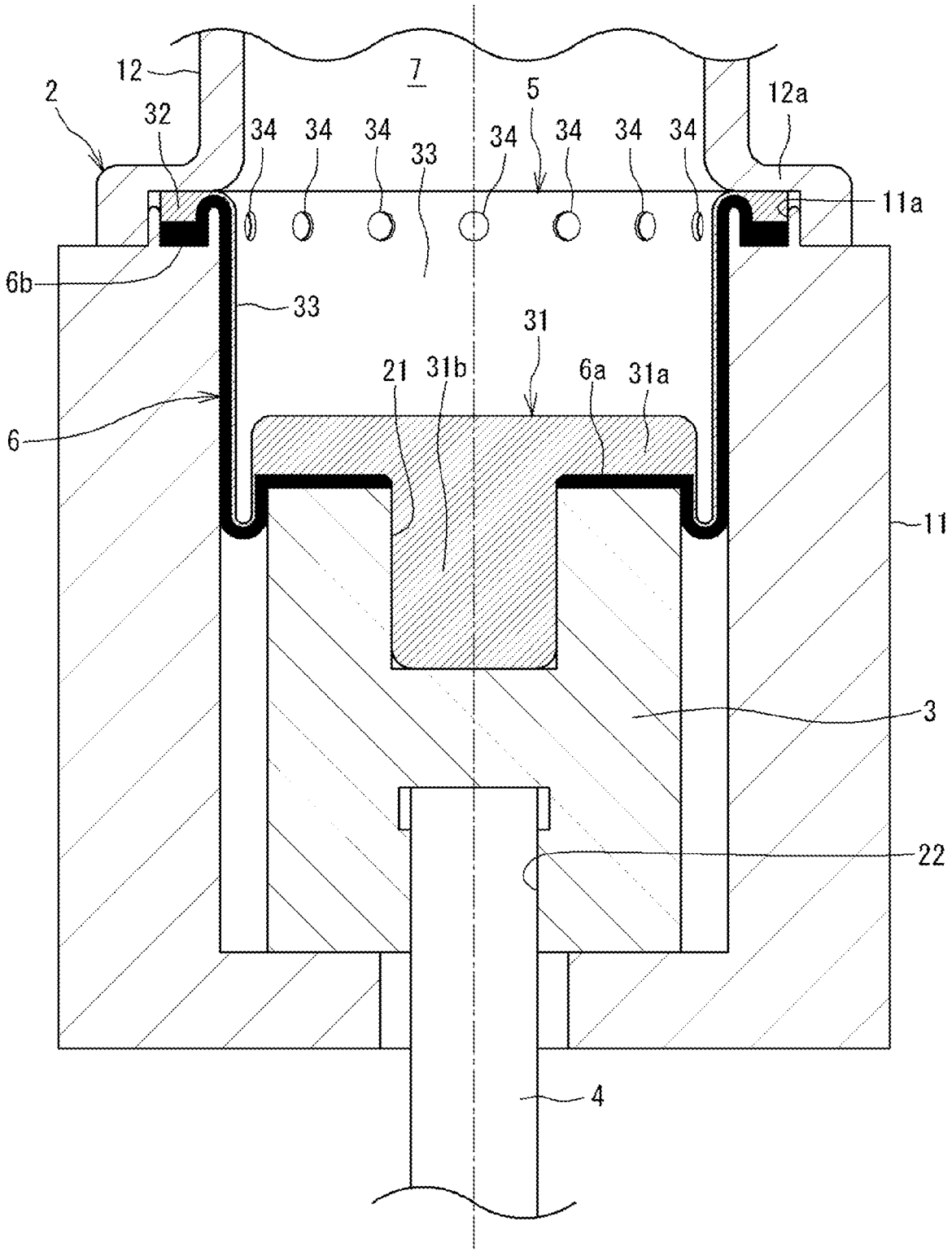
FIG. 2 is an enlarged perspective view of a main part in FIG. 1, showing a rolling diaphragm.

FIG. 2 is an enlarged perspective view of a main part in FIG. 1, showing the rolling diaphragm. The rolling diaphragm 5 is formed from a synthetic resin material (for example, a fluorine resin such as polytetrafluoroethylene (PTFE)) and is housed in the housing 2.

The rolling diaphragm 5 has a circular movable portion 31 mounted on an upper end portion in the axial direction of the piston 3, an annular fixed portion 32 mounted to the housing 2, and a thin film portion 33 connecting the movable portion 31 and the fixed portion 32 to each other. The rolling diaphragm 5 is configured such that the movable portion 31 reciprocates in the axial direction together with the piston 3 via the thin film portion 33 with respect to the fixed portion 32 which is fixed in position by the housing 2.

The fixed portion 32 is held in a state where the fixed portion 32 is pressed downward by a flange portion 12*a*, which is formed at a lower end portion of the pump head 12, in a state where the fixed portion 32 is fitted into an annular recess 11*a* formed on the upper surface of the cylinder 11. Accordingly, the fixed portion 32 is fixed to the housing 2 between the cylinder 11 and the pump head 12.

The movable portion 31 has a disc portion 31*a* having an outer diameter substantially equal to that of the piston 3, and a columnar portion 31*b* which projects coaxially downward from the lower surface of the disc portion 31*a*. The columnar portion 31*b* is fitted and fixed to the first recess 21 of the piston 3. Accordingly, the movable portion 31 is disposed coaxially with the piston 3 and reciprocates together with the piston 3.

The thin film portion 33 connects the inner peripheral end of the fixed portion 32 and the outer peripheral end of the movable portion 31. In addition, the thin film portion 33 is formed in a thin film shape (formed thin), and thus has flexibility. Meanwhile, the movable portion 31 and the fixed portion 32 are formed sufficiently thicker than the thin film portion 33 so as to have rigidity. In the following, the surface, of the thin film portion 33, which comes into contact with a pump chamber 7 (described later) is referred to as an outer peripheral surface, and the surface, of the thin film portion 33, which does not come into contact with the pump chamber 7 is referred to as an inner peripheral surface.

On the rolling diaphragm 5 of the present embodiment, a rubber layer 6 is overlaid, without being adhered thereto, from the lower surface of the disc portion 31*a* of the movable portion 31 to the lower surface of the fixed portion 32 via the inner peripheral surface of the thin film portion 33. Hereinafter, the surface, of the rubber layer 6, which is in contact with the inner peripheral surface of the thin film portion 33 is referred to as an outer surface, and the surface, of the rubber layer 6, which is not in contact with the inner peripheral surface of the thin film portion 33 is referred to as an inner surface.

The rubber layer 6 has elasticity (rubber elasticity). The material of the rubber layer 6 may be a thermosetting elastomer such as natural rubber or synthetic rubber, or a thermoplastic elastomer such as a polyurethane-based resin.

An end portion 6*a* on the disc portion 31*a* side of the rubber layer 6 is held in a state where the end portion 6*a* is interposed between the lower surface of the disc portion 31*a* and the upper surface of the piston 3, by fitting the columnar portion 31*b* into the first recess 21 of the piston 3. Accordingly, the end portion 6*a* of the rubber layer 6 is fixed to the piston 3.

An end portion 6*b* on the fixed portion 32 side of the rubber layer 6 is held in a state where the end portion 6*b* is interposed between the lower surface of the fixed portion 32 and the bottom surface of the recess 11*a*, by the flange portion 12*a* of the pump head 12 pressing the fixed portion 32 downward in a state where the end portion 6*b* is fitted into the recess 11*a* of the cylinder 11 together with the fixed portion 32. Accordingly, the end portion 6*b* of the rubber layer 6 is fixed to the housing 2.

When the piston 3 is at the lowest position shown in FIG. 2 (see also FIG. 1), the thin film portion 33 and the rubber layer 6 are bent in a U cross-sectional shape between the outer peripheral surface of the piston 3 and the inner peripheral surface of the cylinder 11. Specifically, the thin film portion 33 and the rubber layer 6 extend slightly downward along the outer peripheral surface of the piston 3 from the outer peripheral end of the movable portion 31, bend radially outward from a lower end portion of the movable portion 31, and extend upward along the inner peripheral surface of the cylinder 11 to the inner peripheral end of the fixed portion 32. In this state, most of the inner surface, of the rubber layer 6, which is bent radially outward is in close contact with the inner peripheral surface of the cylinder 11.

Figure 3:
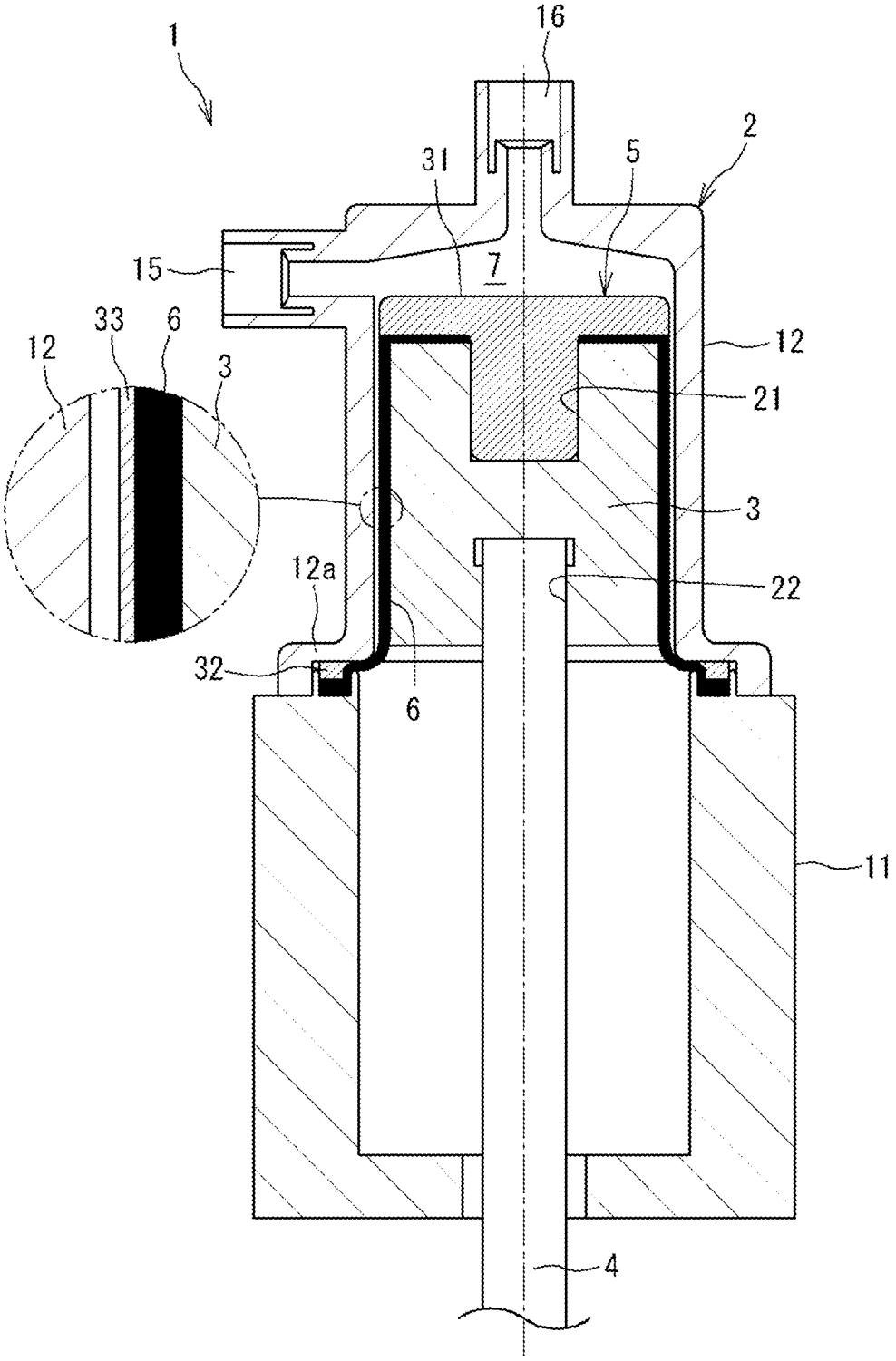
FIG. 3 is a cross-sectional view showing a state where the piston is at an uppermost position in the rolling diaphragm pump.

FIG. 3 is a cross-sectional view showing the pump in a state where the piston 3 is at the uppermost position. As shown in FIG. 3, when the piston 3 moves to the uppermost position, the thin film portion 33 and the rubber layer 6 become deformed into a cylindrical shape along the outer peripheral surface of the piston 3. In this state, most of the inner surface of the rubber layer 6 is in close contact with the outer peripheral surface of the piston 3.

In FIG. 1 and FIG. 3, the pump chamber 7 is defined by the rolling diaphragm 5 in the housing 2 of the pump 1. Specifically, the pump chamber 7 is defined on the upper side in the axial direction with respect to the rolling diaphragm 5 in the housing 2, by the rolling diaphragm 5, and communicates with the suction port 15 and the discharge port 16 of the pump head 12. The volume of the interior of the pump chamber 7 is changed by a bending motion of the rolling diaphragm 5 due to reciprocation of the piston 3.

[Method for Driving Pump]

With the above configuration, in the pump 1, a discharge process in which the piston 3 advances toward the upper side in the axial direction and a suction process in which the piston 3 retracts toward the lower side in the axial direction are alternately and repeatedly performed by the drive device. Accordingly, a liquid stored in the liquid tank or the like can be supplied from the pump 1 to the liquid supply portion.

Specifically, in the suction process, the movable portion 31 of the rolling diaphragm 5 moves downward so as to follow the retraction of the piston 3 (changes from a state shown in FIG. 3 to a state shown in FIG. 1). In this process, the thin film portion 33 of the rolling diaphragm 5 and the rubber layer 6 bend in the gap between the outer peripheral surface of the piston 3 and the inner peripheral surface of the cylinder 11, roll such that the bent position thereof is displaced downward, and then come into a state where most of the inner surface of the rubber layer 6 is in close contact with the inner peripheral surface of the cylinder 11. Accordingly, the volume of the pump chamber 7 is increased, so that the liquid within the liquid tank is sucked through the suction port 15 into the pump chamber 7.

Then, in the discharge process, the movable portion 31 of the rolling diaphragm 5 moves upward so as to follow the advancement of the piston 3 (changes from the state shown in FIG. 1 to the state shown in FIG. 3). In this process, the thin film portion 33 of the rolling diaphragm 5 and the rubber layer 6 roll such that the bent position thereof in the gap between the outer peripheral surface of the piston 3 and the inner peripheral surface of the cylinder 11 is displaced upward, and then come into a state where most of the inner surface of the rubber layer 6 is in close contact with the outer peripheral surface of the piston 3. Accordingly, the volume of the pump chamber 7 is reduced, so that the liquid within the pump chamber 7 is discharged through the discharge port 16.

At the bent portion of the thin film portion 33 in the suction process and the discharge process, as shown in FIG. 1, the rubber layer 6 is pulled in the direction of an arrow a and the direction of an arrow b in the drawing, whereby tension is applied to the bent portion of the rubber layer 6. Accordingly, a force that presses the bent portion of the thin film portion 33 in the direction of white arrows in the drawing, that is, an external force that bends the thin film portion 33, acts on the bent portion of the thin film portion 33 due to the strong restoring force in the bent portion of the rubber layer 6. As a result, the external force that bends the bent portion of the thin film portion 33 is larger than an external force that acts on the non-bent portion (straight portion along the inner peripheral surface of the cylinder 11 in FIG. 1) of the thin film portion 33 and causes wrinkles. Therefore, in the suction process and the discharge process, the occurrence of wrinkles at the non-bent portion of the thin film portion 33 can be suppressed by the rubber layer 6 which is overlaid on the thin film portion 33.

Meanwhile, during manufacture of the pump 1, when the rubber layer 6 is overlaid on the rolling diaphragm 5, air may enter between the thin film portion 33 and the rubber layer 6. In this case, when the piston 3 moves upward from the lowest position in the discharge process of the pump 1 (see FIG. 1), the air between the thin film portion 33 and the rubber layer 6 is trapped between the bent position, of the thin film portion 33, which is displaced upward and the fixed portion 32, and gradually moves upward. Then, when the bent position of the thin film portion 33 approaches the fixed portion 32, the trapped air is accumulated near the fixed portion 32, and expands due to there being no space for further movement. Accordingly, the thin film portion 33 may become plastically deformed by being strongly pressed by the expanded air.

Therefore, a through hole 34 for discharging air that has entered between the thin film portion 33 and the rubber layer 6 to the outside is formed in the thin film portion 33. In the present embodiment, a plurality of through holes 34 are formed in the thin film portion 33 near the fixed portion 32 at predetermined intervals in the circumferential direction of the fixed portion 32. Accordingly, in the discharge process of the pump 1, the bent position of the thin film portion 33 is displaced upward, whereby air between the thin film portion 33 and the rubber layer 6 can be discharged to the outside through the plurality of through holes 34.

Advantageous Effects

As described above, in the rolling diaphragm pump 1 of the present embodiment, since the rubber layer 6 is overlaid on the thin film portion 33 which bends in the rolling diaphragm 5, the occurrence of wrinkles in the rolling diaphragm 5 can be suppressed. In addition, since the rubber layer 6 is overlaid on the thin film portion 33 without being adhered to the thin film portion 33, the occurrence of wrinkles can be suppressed with an inexpensive configuration as compared with the conventional case where a rubber layer is adhered to a rolling diaphragm.

Moreover, since air between the thin film portion 33 and the rubber layer 6 can be discharged to the outside through the through hole 34 formed in the thin film portion 33, plastic deformation of the thin film portion 33 due to the air being trapped between the thin film portion 33 and the rubber layer 6 can be suppressed.

Moreover, since the through hole 34 is formed in the thin film portion 33 near the fixed portion 32, air accumulated near the fixed portion 32 can be efficiently discharged to the outside through the through hole 34. Furthermore, air between the thin film portion 33 and the rubber layer 6 can be more efficiently discharged to the outside through the plurality of through holes 34 formed in the thin film portion 33.

[Others]

The end portion 6*a* of the rubber layer 6 of the above embodiment is fixed to the piston 3 together with the movable portion 31 (disc portion 31*a*) of the rolling diaphragm 5, but may be fixed to the piston 3 separately from the movable portion 31. Similarly, the end portion 6*b* of the rubber layer 6 is fixed to the housing 2 together with the fixed portion 32 of the rolling diaphragm 5, but may be fixed to the housing 2 separately from the fixed portion 32.

The through holes 34 for discharging air between the thin film portion 33 and the rubber layer 6 to the outside are formed in the thin film portion 33 of the rolling diaphragm 5 of the above embodiment. However, in the case where air does not enter between the thin film portion 33 and the rubber layer 6, the through holes 34 do not have to be formed.

The embodiments disclosed herein are merely illustrative in all aspects and should be considered not restrictive. The scope of the present invention is defined by the scope of the claims rather than the meaning described above, and is intended to include meaning equivalent to the scope of the claims and all modifications within the scope.

REFERENCE SIGNS LIST

1 rolling diaphragm pump
2 housing
3 piston
5 rolling diaphragm
6 rubber layer
6*a* end portion
6*b* end portion
7 pump chamber
31 movable portion
32 fixed portion
33 thin film portion
34 through hole

The invention claimed is:

1. A rolling diaphragm pump comprising:

a housing;

a rolling diaphragm defining a pump chamber in the housing and made of a synthetic resin; and a piston disposed in the housing so as to be reciprocatable together with the rolling diaphragm, wherein a transport fluid is sucked and discharged by changing a volume of an interior of the pump chamber by a bending motion of the rolling diaphragm due to reciprocation of the piston, the rolling diaphragm has a movable portion reciprocatable together with the piston, a fixed portion fixed to the housing, and a thin film portion connecting the movable portion and the fixed portion and bending due to the reciprocation of the piston, a rubber layer is overlaid on the thin film portion without being adhered to the thin film portion, and an end portion on a movable portion side of the rubber layer is fixed to the piston, and an end portion on a fixed portion side of the rubber layer is fixed to the housing.

2. The rolling diaphragm pump according to claim 1, wherein a through hole for discharging air between the thin film portion and the rubber layer to the outside is formed in the thin film portion.

3. The rolling diaphragm pump according to claim 2, wherein the through hole is formed in the thin film portion near the fixed portion.

4. The rolling diaphragm pump according to claim 2, wherein a plurality of the through holes are formed in the thin film portion.

* * * * *